US005289111A

United States Patent [19]

Tsuji

[11] Patent Number: 5,289,111

[45] Date of Patent: Feb. 22, 1994

[54] BANDGAP CONSTANT VOLTAGE CIRCUIT

[75] Inventor: Yasuhiko Tsuji, Kyoto, Japan

[73] Assignee: Rohm Co., Ltd., Kyoto, Japan

[21] Appl. No.: 882,601

[22] Filed: May 13, 1992

[30] Foreign Application Priority Data

May 17, 1991 [JP] Japan ..... 3-142364
May 21, 1991 [JP] Japan ..... 3-145483

[51] Int. Cl.[5] ..... G05F 3/16

[52] U.S. Cl. ..... 323/314; 323/313; 323/907

[58] Field of Search ..... 323/313, 314, 901, 907

[56] References Cited

U.S. PATENT DOCUMENTS

| | | | |
|---|---|---|---|
| 3,617,859 | 11/1971 | Dobkin | 323/313 |
| 3,646,436 | 2/1972 | Chan et al. | 323/314 |
| 4,849,684 | 7/1989 | Sonntag et al. | 323/907 |
| 4,939,442 | 7/1990 | Carvajal et al. | 323/314 |
| 5,084,665 | 1/1992 | Dixon et al. | 323/901 |
| 5,087,830 | 2/1992 | Cave et al. | 323/314 |

*Primary Examiner*—Jeffrey Sterrett
*Attorney, Agent, or Firm*—Pollock, VandeSande & Priddy

[57] ABSTRACT

A constant voltage circuit is to stabilize a constant voltage output with respect to a source voltage and produce the constant voltage output at a lower level of the source voltage. The constant voltage circuit is arranged to generate an output of constant voltage (constant voltage Vreg) by using a band-gap circuit (2), and comprises an error detecting circuit (4) for detecting an error voltage between the constant voltage generated by the band-gap circuit and a setting value, an output circuit (6) for receiving a current indicative of the error voltage from the error detecting circuit, generating a current depending on the received current, and feeding the generated current back to the band-gap circuit, and an initiating circuit (8) for supplying an initiation current to the band-gap circuit at the time of raising a source voltage.

7 Claims, 6 Drawing Sheets

BANDGAP CONSTANT VOLTAGE CIRCUIT

BACKGROUND OF THE INVENTION

1. Field of the Invention

The present invention relates to a constant voltage circuit using a band-gap circuit.

2. Description of the Prior Art

As means for applying a reference voltage to various electronic circuits, there has been conventionally used a constant voltage circuit utilizing a band-gap circuit. FIG. 4 shows one example of this type constant voltage circuit. More specifically, the illustrated constant voltage circuit comprises a band-gap circuit 2 for generating a reference voltage, an error detecting circuit 4 for detecting an error voltage of the constant voltage outputted from the band-gap circuit 2, and an output circuit 6.

The band-gap circuit 2 includes a serial circuit comprising a resistor 21, a transistor 22, diodes 23, 24 and a resistor 25, and a serial circuit comprising a resistor 26 and diodes 27, 28, 29, these serial circuits being arranged in parallel. A bias voltage created by the diodes 27, 28, 29 is applied to a base of the transistor 22. A power source is connected to the band-gap circuit 2 via a resistor 61 in the output circuit 6 and a source voltage Vcc is applied to a source terminal 10. A value of the resistor 21 is set so that the base and collector of the transistor 22 are at the same potential. Assuming now in the band-gap circuit 2 that a current flowing toward the side of the diodes 23, 24 and the resistor 25 through the transistor 22 is $I_1$, a current flowing toward the side of the diodes 27, 28, 29 therethrough is $I_2$, resistance values of the resistors 21, 25 are $R_1$, $R_2$, the diodes 27, 28, 29 each comprise a transistor, and a base-emitter voltage of each transistor is $V_{BE}$, A constant voltage Vreg outputted from the band-gap circuit 2 is given by;

$$Vreg = 3V_{BE} + 3 \cdot \frac{R_1}{R_2} \cdot \frac{kT}{q} \ln \frac{I_2}{I_1} \quad (1)$$

where the magnitudes of the currents $I_1$, $I_2$ are set to meet a relationship of $I_2 > I_1$, k is the Boltzmann constant, q is the quantity of electric charge of an electron, T is a temperature, and kT/q is a constant. By properly selecting respective values of the resistors 21, 25, 26, a temperature coefficient of the constant voltage Vreg outputted from the band-gap circuit 2 can be made zero.

The error detecting circuit 4 includes a differential circuit comprising a pair of transistors 41, 42 of which emitters are connected in common to each other. Connected to the emitter side of the transistors 41, 42 constituting the differential pair is in series a transistor 43 through which an operating current flows to the differential pair. The diode 29 in the band-gap circuit 2 is connected between a base and an emitter of the transistor 43. The diode 29 and the transistor 43 jointly constitute a current mirror circuit so that the current $I_2$ flows through the transistor 43 and serves as an operating current for the differential circuit. A voltage drop across the resistor 21 due to the current $I_1$, i.e., a collector voltage of the transistor 22, is applied to a base of the transistor 41 and a base voltage of the transistor 22 is applied to a base of the transistor 42. The base voltage and the collector voltage of the transistor 22 are compared with each other in the differential circuit to detect an error voltage therebetween. Thus, a current depending on increase or decrease of the error voltage flows through the transistors 41, 42 of the differential circuit. In the illustrated case, when the collector voltage of the transistor 22 is higher than the base voltage thereof, a current corresponding to the error voltage flows through the transistor 41. Transistors 44, 45 jointly constituting a current mirror circuit are connected as an active circuit between collectors of the transistors 41, 42 and an output terminal 12, whereby the current corresponding to the error voltage is taken out from the collector side of the transistors 41, 45.

The output circuit 6 includes a resistor 61 and transistors 62, 63 which are connected in a Darlington arrangement. A base of the transistor 62 is connected to the collectors of the transistors 41, 45. Therefore, when a current representing the error voltage flows through the transistor 41, the current is pulled from the base of the transistor 62 and a base current depending on the error voltage flows through the transistor 62. The current flowing through the transistor 41 is multiplied by a current amplification factor of the transistors 62, 63 and then discharged from the source side to the ground side through the resistor 61. At this time, there occurs a voltage drop across the resistor 61 depending on the current flowing through the transistor 63. Therefore, as the current flowing through the transistor 41 increases, the current flowing through the resistor 61 is increased to enlarge the voltage drop and thus lower the constant voltage Vreg. On the other hand, as the current flowing through the transistor 41 decreases, the current flowing through the resistor 61 is decreased to reduce the voltage drop and thus lower the constant voltage Vreg. By so controlling the current flowing through the resistor 61 in accordance with the error voltage, the constant voltage Vreg taken out from the output terminal 12 is stabilized.

Next, FIG. 5 shows another example of the above type conventional constant voltage circuit using a band-gap circuit. In this constant voltage circuit, instead of the resistor 61 shown in FIG. 4, a resistor 64 and a transistor 66 are provided in the output circuit 6 besides the transistors 62, 63, with an emitter of the transistor 62 directly connected to the source line. The constant voltage circuit shown in FIG. 5 can also similarly stabilize the constant voltage Vreg to be taken out from the output terminal 12.

However, the constant voltage circuit shown in FIG. 4 has such disadvantages as that since a load current flows through the resistor 61 and produces large power, the resistor 61 must be outside an integrated circuit, that the current which flows through the transistor 63 for stabilization becomes a reactive current, and that because of the reactive current being large, the transistor 63 is required to have a large capacity. Also, the constant voltage circuit shown in FIG. 5 has such disadvantages as that since the transistors 63, 66 provided in the output circuit 6 each comprise an NPN type transistor, the constant voltage Vreg to be obtained cannot become greater than the value of source voltage Vcc−base-emitter voltage $V_{BE}$, and that a large reactive current flows through the transistor 63 as with the constant voltage circuit shown in FIG. 4. Further, either constant voltage circuit requires the source voltage Vcc to be high in raising of the constant voltage Vreg. Another disadvantage of each constant voltage circuit is in that Vreg−Vcc characteristics are changed to a considerable extent depending on temperatures as exemplified at $T_1$ (=50° C.), $T_2$ (=75° C.), $T_3$ (=25° C.), $T_4$ (=−5° C.) and $T_5$ (=−25° C.) shown in FIG. 6.

SUMMARY OF THE INVENTION

It is therefore an object of the present invention to provide a constant voltage circuit which can stabilize a constant voltage output with respect to a source voltage and improve temperature characteristics.

Another object of the present invention is to provide a constant voltage circuit which can stabilize a constant voltage output with respect to a source voltage and produce a constant voltage output at a lower level of the source voltage.

A constant voltage circuit of the present invention is to generate an output of constant voltage (constant voltage Vreg) by using a band-gap circuit (2), and comprises an error detecting circuit (4) for detecting an error voltage between the constant voltage generated by the band-gap circuit and a setting value, an output circuit (6) for receiving a current indicative of the error voltage from the error detecting circuit, generating a current depending on the received current, and feeding the generated current back to the band-gap circuit, and an initiating circuit (8) for supplying an initiation current to the band-gap circuit at the time of raising a source voltage.

Furthermore, in the constant voltage circuit of the present invention, the initiating circuit (8) comprises a bias circuit for receiving the source voltage (Vcc) and generating a constant bias voltage by a plurality of diodes (803 to 807), a first transistor (801) conducted by the bias circuit at the time of initiation, and a second transistor (809) for receiving a conduction current of the first transistor or a current produced by the output circuit and supplying an operating current to the error detecting circuit.

When the source voltage rises, the band-gap circuit is initiated by an initiation current flowing into the same from the initiating circuit and driven by the source voltage Vcc applied through the initiating circuit. More specifically, the initiating circuit receives a current indicative of the error voltage from the error detecting circuit, and supplies a current depending on the received current, as the initiation current, to the band-gap circuit. As a result, the band-gap circuit is initiated and an output of constant voltage is obtained. The constant voltage Vreg obtained by the band-gap circuit is given as expressed by the aforesaid equation (1). An error voltage representing the error between the constant voltage created in the band-gap circuit and a setting value is detected through a differential circuit in the error detecting circuit so that a current indicative of the error voltage flows through the differential circuit. This current then flows from the error detecting circuit to the output circuit and, thereafter, it is fed back to the band-gap circuit side through the output circuit as a current for stabilizing the constant voltage. The constant voltage output is thus stabilized.

Alternatively, when the source voltage rises, the first transistor (801) is conducted with application of the bias voltage upon receiving the source voltage (Vcc). Then, upon receiving a conduction current of the first transistor, an operating current is supplied to the error detecting circuit (4) through the second transistor (809). As a result, the error detecting circuit is operated and the constant voltage output is raised. As soon as the constant voltage output is raised, the first transistor (801) is brought into a cut-off state in which the transistor is under the constant bias voltage through the bias circuit comprising the plurality of diodes (803 to 807) by receiving the source voltage. Accordingly, the first transistor gives rise to not effect on the constant voltage output.

DETAILED DESCRIPTION OF THE PREFERRED EMBODIMENTS

First Embodiment

Figure 1:
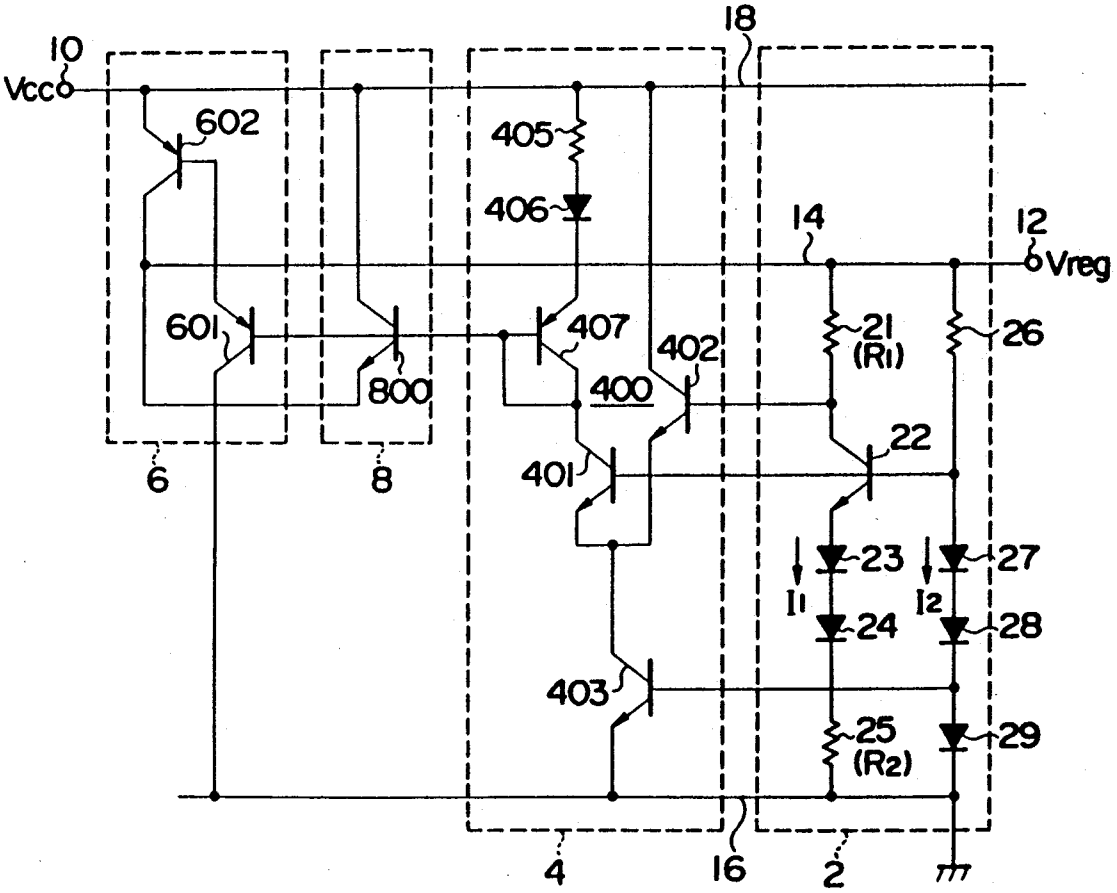
FIG. 1 is a circuit diagram showing a first embodiment of a constant voltage circuit of the present invention.

FIG. 1 shows a first embodiment of a constant voltage circuit of the present invention. This constant voltage circuit comprises a band-gap circuit 2 for generating a reference voltage, an error detecting circuit 4, an output circuit 6 and an intiating circuit 8. The band-gap circuit 2 includes, between a constant voltage output line 14 and a ground line 16 serving as a reference potential point, a serial circuit comprising a resistor 21, a transistor 22, diodes 23, 24 and a resistor 25, and a serial circuit comprising a resistor 26 and diodes 27, 28, 29. The serial circuit comprising the resistor 26 and the diodes 27, 28, 29 constitutes a bias circuit for the transistor such that a voltage produced at the junction between the resistor 26 and the diode 27 is applied to a base of the transistor 22. Let it now be assumed that a current flowing toward the side of the diodes 23, 24 through the transistor 22 is $I_1$ and a current flowing toward the side of the diodes 27, 28, 29 therethrough is $I_2$. A base voltage of the transistor 22 is given by $V_{BE}$ (=3 $V_F$) on the assumption that a diode voltage of each of the diodes 27, 28, 29 is $V_F$, or that a base-emitter voltage of a transistor constituting each of those diodes is $V_{BE}$. Also, a collector voltage of the transistor 22 is given by a voltage drop $R_1 \cdot I_1$ across the resistor 21 on the assumption that a resistance value of the resistor 21 is $R_1$. In the band-gap circuit 2, therefore, the base voltage and the collector voltage of the transistor 22 are set equal to each other in order to obtain a constant voltage Vreg.

The error detecting circuit 4 is provided to determine an error voltage in the band-gap circuit 2, i.e., a differential voltage between the base voltage and the collector voltage of the transistor 22. The error detecting circuit 4 includes a differential circuit 400 comprising a pair of transistors 401, 402 of which emitters are connected in common to each other. The base of the transistor 22 is connected to a base of the transistor 401 for applying the base voltage of the transistor 22 thereto, while the collector of the transistor 22 is connected to a base of the transistor 402 for applying the collector voltage of the transistor 22 thereto. Between emitters of the transistors 401, 402 and the ground line 16, there is connected a transistor 403 as means for supplying an operating current to the differential circuit 400. A base of the transistor 403 is connected to a junction between the two diodes 28 and 29 in the band-gap circuit 2. In other words, the diode 29 constitutes a bias circuit for the transistor 403, whereas the diode 29 and the transistor 403 jointly constitute a current mirror circuit. A source line 18 is directly connected to a collector of the transistor 402 so that a source voltage Vcc is applied to the collector of the transistor 402. Further, a resistor 405, a diode 406 and a transistor 407 are connected in series between a collector of the transistor 401 and the source line 18. The transistor 407 is connected in a diode arrangement, that is to say, its base and collector are connected in common to each other. The resistor 405, diode 406 and transistor 407 serve as an active load for the differential circuit 400 and constitute current take-out means for taking out a current flowing through the transistor 401, i.e., a current corresponding to the error voltage.

The output circuit 6 is means for receiving an output of the error detecting circuit 4 and stabilizing the constant voltage Vreg to be taken out. The output circuit 6 includes a transistor 601 of which base is connected to the common base and collector side of the transistor 407, and a transistor 602 connected between the constant voltage output line 14 and the source line 18. An emitter of the transistor 601 is connected to a base of the transistor 602 so that a base current of the transistor 602 is applied from the transistor 601. The transistor 601 consitutes a current mirror circuit in cooperation with the transistor 407 and the current corresponding to the error voltage, i.e., the current obtained through the transistor 407, is supplied to the transistor 601. As a result, depending on an increase or decrease of the error voltage, a current tending to suppress such increase or decrease flows through the transistor 602.

Finally, the initiating circuit 8 is means for supplying an initiation current to the band-gap circuit 2 and includes a transistor 800 connected between the source line 18 and the constant voltage output line 14. A base of the transistor 800 is connected to the common base and collector side of the transistor 407 for applying a base voltage to the transistor 800.

Operation of the constant voltage circuit thus arranged will now be described. When a power switch (not shown) is turned on to raise the source voltage Vcc, a current flows through the resistor 405, the diode 406 and the transistor 407 of the error detecting circuit 4, whereupon the base voltage is applied to the transistor 800, allowing the transistor 800 to conduct. Accordingly, applied to the constant voltage output line 14 of the band-gap circuit 2 is a voltage ($Vcc-3\ V_{BE}$) resulted by subtracting the total of a forward voltage drop of the diode 406, a base-emitter voltage of the transistor 407 and a base-emitter voltage of the transistor 800, i.e., $3\ V_{BE}$, from the source voltage Vcc, so that an initiation current flows from the source line 18 to the band-gap circuit 2 through the transistor 800. As a result, the band-gap circuit 2 is initiated to produce the constant voltage Vreg at the output terminal 12.

Here, the constant voltage Vreg is given by the above-mentioned equation (1). As seen from the equation (1), assuming that $I_2/I_1=S$ holds when the constant voltage Vreg is at a setting value, $I_2/I_1>S$ is resulted to make the base voltage of the transistor 402 higher if the constant voltage Vreg becomes higher than the setting value. Also, $I_2/I_1<S$ is resulted to make the base voltage of the transistor 402 lower if the constant voltage Vreg becomes lower than the setting value.

Such an error voltage produced between the constant voltage Vreg and the setting value is detected by the error detecting circuit 4. More specifically, when the base voltage of the transistor 402 becomes higher, the transistor 402 is conducted. On the other hand, when the base voltage of the transistor 401 becomes higher, the transistor 401 is conducted and the current flowing through the transistor 401 flows through the transistor 407 as well. Due to a current mirror effect, the current flowing through the transistor 407 also flows through the transistor 601 and a base current of the transistor 602 is applied from the transistor 601. Thus, the current flowing through the transistor 601 further flows through the transistor 602 while being multiplied by a current amplification factor of the transistor 602, and the multiplied current is supplied to the band-gap circuit 2 from the constant voltage output line 14. As a result, the constant voltage Vreg is so stabilized that the constant voltage Vreg at the setting value can be always obtained.

As will be apparent from the foregoing operation, therefore, the constant voltage circuit of this embodiment produces a less reactive current than in the conventional circuit, thus enabling a higher degree of efficiency with less power loss. Also, the constant voltage circuit of this embodiment can be constituted in the form of a single semiconductor integrated circuit.

Figure 2:
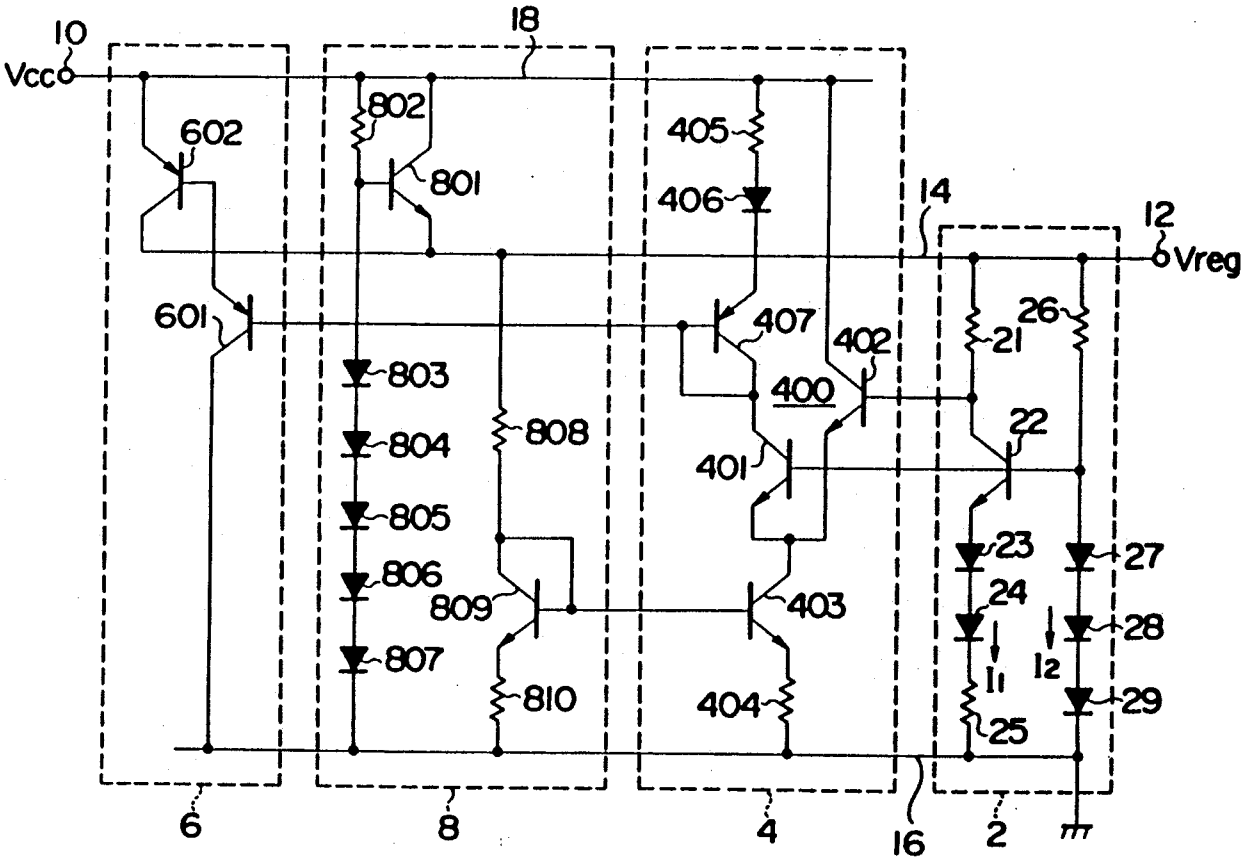
FIG. 2 is a circuit diagram showing a second embodiment of the constant voltage circuit of the present invention.

FIG. 2 shows a second embodiment of the constant voltage circuit of the present invention. This constant voltage circuit comprises, like the above first embodiment, a band-gap circuit 2 for generating a reference voltage, an error detecting circuit 4, an output circuit 6 and an initiating circuit 8.

The band-gap circuit 2 includes, between a constant voltage output line 14 and a ground line 16 serving as a reference potential point, a serial circuit comprising a resistor 21, a transistor 22, diodes 23, 24 and a resistor 25, and a serial circuit comprising a resistor 26 and diodes 27, 28, 29. The serial circuit comprising the resistor 26 and the diodes 27, 28, 29 constitutes a bias circuit for the transistor 22 such that a voltage produced at the junction between the resistor 26 and the diode 27 is applied to a base of the transistor 22. Let it now be assumed that a current flowing toward the side of the diodes 23, 24 through the transistor 22 is $I_1$ and a current flowing toward the side of the diodes 27, 28, 29 therethrough is $I_2$. A base voltage of the transistor 22 is given by $V_{BE}(=3\ V_F)$ on the assumption that a diode voltage of each of the diodes 27, 28, 29 is $V_F$, or that a base-emitter voltage of the transistor 22, i.e., a transistor constituting each of those diodes, is $V_{BE}$. Also, a collector voltage of the transistor 22 is given by a voltage drop $R_1 \cdot I_1$ across the resistor 21 on the assumption that a resistance value of the resistor 21 is $R_1$. In the band-gap circuit 2, therefore, the base voltage and the collector voltage of the transistor 22 are set equal to each other in order to obtain a constant voltage Vreg.

The error detecting circuit 4 is provided to determine an error voltage in the band-gap circuit 2, i.e., a differential voltage between the base voltage and the collector voltage of the transistor 22. The error detecting circuit 4 includes a differential circuit 400 comprising a pair of transistors 401, 402 of which emitters are connected in common to each other. The base of the transistor 22 is connected to a base of the transistor 401 for applying the base voltage of the transistor 22 thereto, while the collector of the transistor 22 is connected to a base of the transistor 402 for applying the collector voltage of the transistor 22 thereto. Between emitters of the transistors 401, 402 and the ground line 16, there is connected a serial circuit, comprising a transistor 403 and a resistor 404, as means for supplying an operating current to the differential circuit 400. A base current of the transistor 403 is applied from the initiating circuit 8. A source line 18 is directly connected to a collector of the transistor 402 so that a source voltage Vcc is applied to the collector of the transistor 402. Further, a resistor 405, a diode 406 and a transistor 407 are connected in series between a collector of the transistor 401 and the source line 18. The transistor 407 is connected in a diode arrangement, that is to say, its base and collector are connected in common to each other. The resistor 405, diode 406 and transistor 407 serve as an active load for the differential circuit 400 and constitute current take-out means for taking out a current flowing through the transistor 401, i.e., a current corresponding to the error voltage.

The initiating circuit 8 is to initiate the band-gap circuit 2 and supply an operating current to the error detecting circuit 4. The initiating circuit 8 includes a transistor 801 connected between the source line 18 and the constant voltage output line 14. Applied to a base of the transistor 800 is a constant bias voltage through a bias circuit comprising a resistor 802 and diodes 803, 804, 805, 806, 807 which are connected between the source line 18 and the ground line 16. In this case, the bias voltage is created by a total of forward voltage drops across the plural diodes 803, 804, 805, 806, 807. Further, a serial circuit comprising a resistor 808, a second transistor 809 and a resistor 810 is connected between the constant voltage line 14 and the ground line 16. The transistor 809 has its base and collector connected in common to each other, and a base of the transistor 403 is connected to the common base and collector side of the transistor 809. In other words, the transistors 403, 809 jointly constitute a current mirror circuit, and the serial circuit comprising the resistor 808, the transistor 809 and the resistor 810 constitutes a bias circuit for the transistor 403, the bias circuit receiving the constant voltage Vreg to generate a certain bias voltage.

Finally, the output circuit 6 is means for receiving an output of the error detecting circuit 4 and stabilizing the constant voltage Vreg to be taken out. The output circuit 6 includes a transistor 601 of which base is connected to the common base and collector side of the transistor 407, and a transistor 602 connected between the constant voltage output line 14 and the source line 18. An emitter of the transistor 601 is connected to a base of the transistor 602 so that a base current of the transistor 602 is applied from the transistor 601. The transistor 601 constitutes a current mirror circuit in cooperation with the transistor 407 and the current corresponding to the error voltage, i.e., the current obtained through the transistor 407, is supplied to the transistor 601. As a result, depending on an increase or decrease of the error voltage, a current tending to suppress such increase or decrease flows through the transistor 602.

Operation of the constant voltage circuit thus arranged will now be described. When a power switch (not shown) is turned on to raise the source voltage Vcc, the bias circuit comprising the resistor 802 and the diodes 803 to 807 in the initiating circuit 8 produces the constant bias voltage, allowing the transistor 801 to conduct with the produced bias voltage. Accordingly, a current flows through the resistor 808, the transistor 809 and the resistor 810 from the transistor 801, whereby an operating current depending on that current is supplied to the differential circuit 400 through the transistor 403. At the same time, the operating current also flows through the band-gap circuit 2 from the transistor 801, whereby the band-gap circuit 2 is initiated so that the constant voltage Vreg appears at the output terminal 12. Then, the base voltage of the transistor 801 is clamped to a level 5 $V_F$ established by the forward voltage drops across the diodes 803 to 807. Because of the voltage 5 $V_F$ being lower than the constant voltage Vreg, the transistor 801 is brought into a cut-off state after the initiation.

Here, the constant voltage Vreg is given by the above-mentioned equation (1). As seen from the equation (1), similarly to the above first embodiment, assuming that $I_2/I_1=S$ holds when the constant voltage Vreg is at a setting value, $I_2/I_1>S$ is resulted to make the base voltage of the transistor 402 higher if the constant voltage Vreg becomes higher than the setting value. Also, $I_2/I_1<S$ is resulted to make the base voltage of the transistor 402 lower if the constant voltage Vreg becomes lower than the setting value.

Such an error voltage produced between the constant voltage Vreg and the setting value is detected by the error detecting circuit 4. More specifically, when the base voltage of the transistor 402 becomes higher, the transistor 402 is conducted. On the other hand, when the base voltage of the transistor 401 becomes higher, the transistor 401 is conducted and the current flowing through the transistor 401 flows through the transistor 407 as well. Due to a current mirror effect, the current flowing through the transistor 407 also flows through the transistor 601 and a base current of the transistor 602 is applied from the transistor 601. Thus, the current flowing through the transistor 601 further flows through the transistor 602 while being multiplied by a current amplification factor of the transistor 602, and the multiplied current flows through the resistor 808, the transistor 809 and the resistor 810 of the initiating circuit 8, thereby providing an operating current for the differential circuit 400 due to a current mirror effect with the combination of the transistors 809 and 403. As a result, the constant voltage Vreg is so stabilized that the constant voltage Vreg at the setting value can be always obtained.

As will be apparent from the foregoing operation, this constant voltage circuit has features below.

a. A range of stabilizing the constant voltage Vreg with respect to the source voltage Vcc can be enlarged. More specifically, since the bias circuit in the initiating circuit 8 comprises the resistor 802 and the diodes 803 to 807 and the base voltage of the transistor 801 is determined by a total of forward voltage drops, i.e., 5 $V_F$, across the diodes 803 to 807 cascaded, the initiation is not affected by the source voltage Vcc and thus the range of stabilizing the constant voltage Vreg is enlarged.

b. The constant voltage Vreg can be raised at a lower level of the source voltage Vcc. For raising the constant voltage Vreg, the transistor 403 must be brought into an operative state. The voltage at which the transistor 403 is allowed to operate is given by $Vcc=2\ V_F+\alpha$, where $\alpha$ represents voltage drops across the resistors 808, 810.

Figure 3:
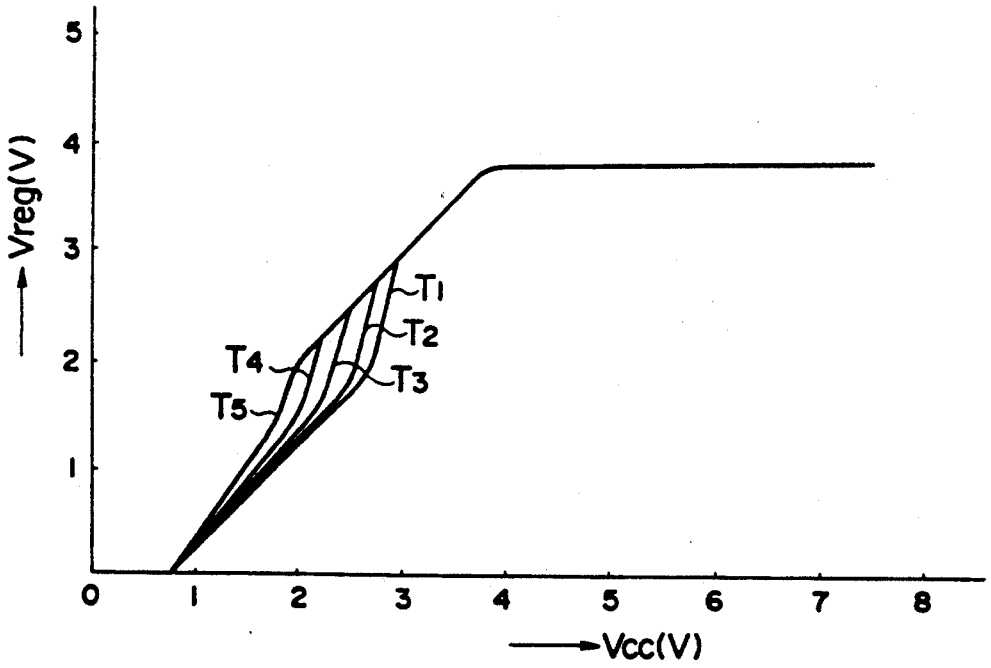
FIG. 3 is a graph showing operating characteristics of the constant voltage circuit shown in FIG. 2.
Figure 4:
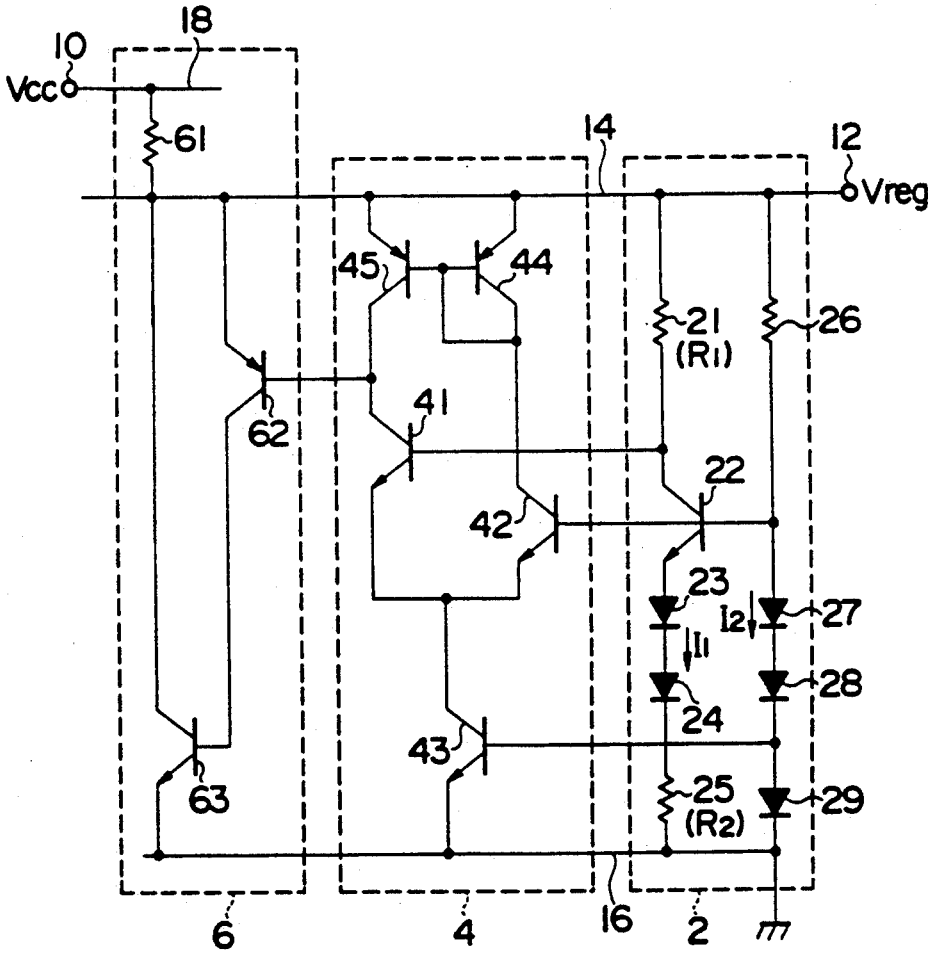
FIG. 4 PRIOR ART
FIG. 4 is a circuit diagram showing a conventional constant voltage circuit.
Figure 5:
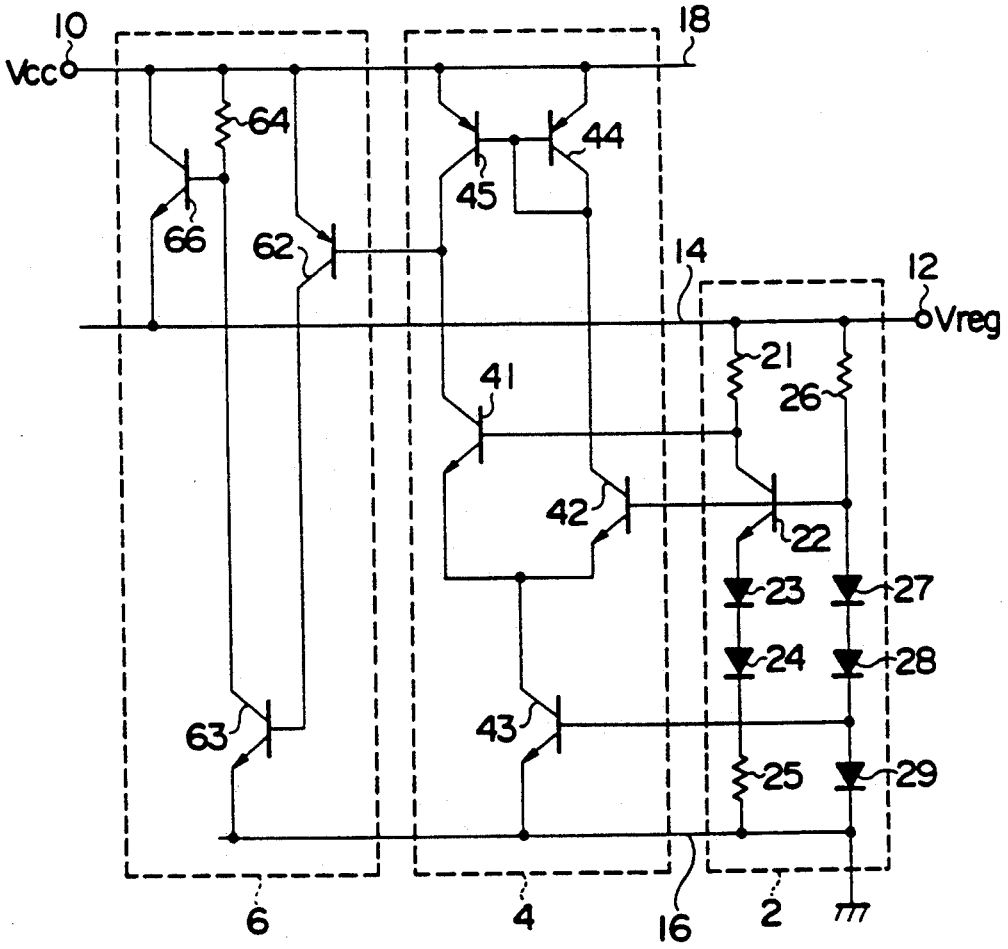
F I G. 5 PRIOR ART
FIG. 5 is a circuit diagram showing another conventional constant voltage circuit.
Figure 6:
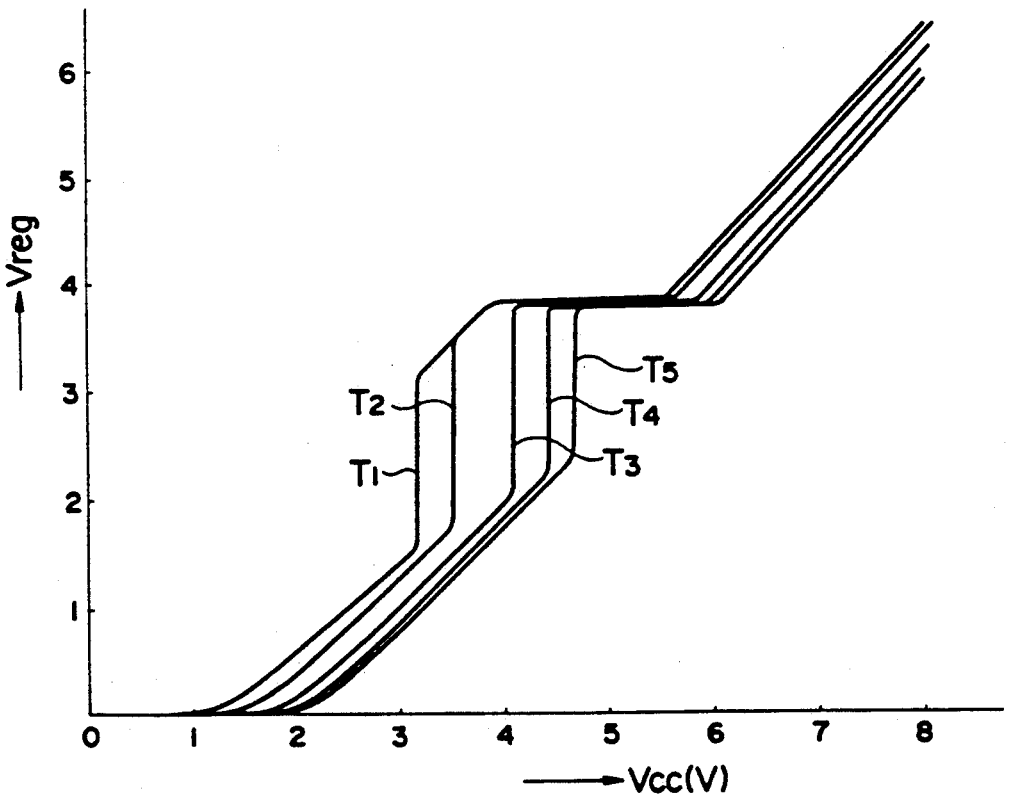
F I G. 6 PRIOR ART
FIG. 6 is a graph showing operating characteristics of the conventional constant voltage circuit.

Therefore, the constant voltage Vreg can be generated at a quite low level of the source voltage Vcc.

c. A change in temperature characteristics of the source voltage Vcc for raising the constant voltage Vreg can be made small. Since the voltage condition required to raise the constant voltage Vreg is given by $Vcc=2V_F+\alpha$ and less affected by the forward voltage drop (i.e., the base-emitter voltage of the transistor), the temperature characteristics are improved. FIG. 3 shows characteristics of the constant voltage Vreg versus the source voltage Vcc in the constant voltage circuit of this embodiment at temperatures of $T_1$ (=50° C.), $T_2$ (=75° C.), $T_3$ (=25° C.), $T_4$ (=−5° C.) and $T_5$ (=−25° C.). As will be apparent from the plotted characteristics, the constant voltage Vreg which is stable regardless of temperature changes can be obtained.

d. The constant voltage circuit of this embodiment produces a less reactive current than in the conventional circuit, thus enabling a higher degree of efficiency with less power loss.

e. The constant voltage circuit of this embodiment can be constituted in the form of a single semiconductor integrated circuit.

As described above, according to the present invention, it is possible to realize a constant voltage circuit with low consumption of power, produce a constant voltage output at a lower source voltage, and constitute the circuit in the form of a single semiconductor integrated circuit.

Also, according to the present invention, it is possible to enlarge a range of stabilizing an output of constant voltage with respect to the source voltage, raise the constant voltage at a lower level of the source voltage, and make a temperature coefficient of the constant voltage smaller.

What is claimed is:

1. A constant voltage circuit for generating an output of constant voltage by using a band-gap circuit generating a constant voltage, comprising:

an error detecting circuit for detecting an error voltage between the constant voltage generated by said band-gap circuit and a reference voltage value, generating a current representing the error voltage, an output circuit for receiving said current indicative of said error voltage from said error detecting circuit, generating a current depending on the received current, and feeding said generated current back to said band-gap circuit, an initiating circuit for supplying an initiation current to said band-gap circuit at the time of raising a source voltage applied to said band-gap circuit, wherein said initiating circuit includes a bias circuit for receiving said source voltage and generating a constant bias voltage by a plurality of diodes, a first transistor conducted by said bias circuit at the time of initiation, and a second transistor for receiving a conduction current of said first transistor or a current produced by said output circuit and supplying an operating current to said error detecting circuit.

2. A constant voltage circuit according to claim 1, wherein said error detecting circuit, said output circuit, and said initiating circuit are mounted on a single semiconductor integrated circuit.

3. A constant voltage circuit according to claim 1, wherein said band-gap circuit comprises a first serial circuit including a resistor and a diode which are connected between a constant voltage line and a reference potential point, and a second serial circuit including a transistor, a diode and a resistor, and a voltage at the junction between the resistor and the diode of said first serial circuit applied to a base of the transistor of said second serial circuit.

4. A constant voltage circuit according to claim 1, wherein said output circuit comprises:

a third transistor receiving at its base an error current from said error detecting circuit, and a fourth transistor receiving its base current through said third transistor and feeding a current depending on said error current back to said band-gap circuit.

5. A constant voltage circuit according to claim 3, wherein said error detecting circuit comprises a differential circuit for outputting a differential voltage between a base voltage and a collector voltage of the transistor in said band-gap circuit on the side of said second serial circuit.

6. A constant voltage circuit according to claim 3, wherein said error detecting circuit includes a transistor differential circuit for outputting a differential voltage between a base voltage and a collector voltage of the transistor in said band-gap circuit on the side of said second serial circuit, and a serial circuit including a resistor, a diode, and a transistor having its base and collector connected in common to each other and connected between a collector of one of two transistors, which constitute said transistor differential circuit, and a power source.

7. A constant voltage circuit according to claim 6, wherein said initiating circuit is formed by connecting a transistor between a source line and said constant voltage line, and connecting a base of said latter transistor to the common base and collector side of said transistor which is connected to said transistor differential circuit in series.

* * * * *